US010793337B1

(12) United States Patent
Piscopo

(10) Patent No.: US 10,793,337 B1
(45) Date of Patent: Oct. 6, 2020

(54) FOLDING CORNER PROTECTORS

(71) Applicant: Gene Piscopo, Longwood, FL (US)

(72) Inventor: Gene Piscopo, Longwood, FL (US)

( * ) Notice: Subject to any disclaimer, the term of this patent is extended or adjusted under 35 U.S.C. 154(b) by 47 days.

(21) Appl. No.: 16/204,592

(22) Filed: Nov. 29, 2018

Related U.S. Application Data

(60) Provisional application No. 62/592,163, filed on Nov. 29, 2017.

(51) Int. Cl.
*B65D 81/00* (2006.01)
*B65D 81/05* (2006.01)

(52) U.S. Cl.
CPC ..... *B65D 81/057* (2013.01); *B65D 2581/053* (2013.01); *Y10T 428/24008* (2015.01); *Y10T 428/24223* (2015.01); *Y10T 428/24231* (2015.01); *Y10T 428/24264* (2015.01); *Y10T 428/24273* (2015.01)

(58) Field of Classification Search
CPC ..... Y10T 428/24008; Y10T 428/24223; Y10T 428/24231; Y10T 428/24264; Y10T 428/24273; B65D 81/057; B65D 81/053; B65D 81/056
See application file for complete search history.

(56) References Cited

U.S. PATENT DOCUMENTS

2019/0016519 A1* 1/2019 Neale ..... B65D 5/50

* cited by examiner

*Primary Examiner* — Alexander S Thomas
(74) *Attorney, Agent, or Firm* — Allen Dyer Doppelt & Gilchrist, PA

(57) ABSTRACT

A corner protector is folded from a single sheet of cardboard or similar material along a plurality of lines of weakness. The corner protector includes multiple layers of protection preventing penetration of an apex of the corner protector by a corner received therein.

1 Claim, 6 Drawing Sheets

FOLDING CORNER PROTECTORS

CROSS-REFERENCE TO RELATED APPLICATION

This application claims the benefit of U.S. Provisional Patent Application Ser. No. 62/592,163, filed on Nov. 29, 2017, the contents of which are herein incorporated by reference in their entirety.

FIELD OF THE INVENTION

The present invention relates to protective coverings for corners to prevent damage when stored, handled or shipped, and more particularly, to foldable corner protectors for sheet metal components.

BACKGROUND OF THE INVENTION

When shipping, storing or handling items, protruding corners are among the most likely areas to be damaged. For example, in the auto salvage industry, it is necessary to remove and store items like intact hoods and tailgates from otherwise wrecked vehicles for eventual shipping to a body shop for reuse. Even when padding or the like is applied over the corners, their inherently sharp nature will often penetrate such padding and damage can still occur. Additionally, the margin on such parts is often quite low, and any protective solution must not result in prohibitive expense.

SUMMARY OF THE INVENTION

In view of the foregoing, it is an object of the present invention to provide an improved corner protector that can be quickly and easily folded from a single sheet of cardboard or similar material. The corner protector includes multiple layers of protection preventing penetration of an apex of the corner protector by a corner received therein. These and other objects, aspects and advantages of the present invention will be better appreciated in view of the drawings and following detailed description of preferred embodiments.

DETAILED DESCRIPTION OF PREFERRED EMBODIMENTS

Figure 1:
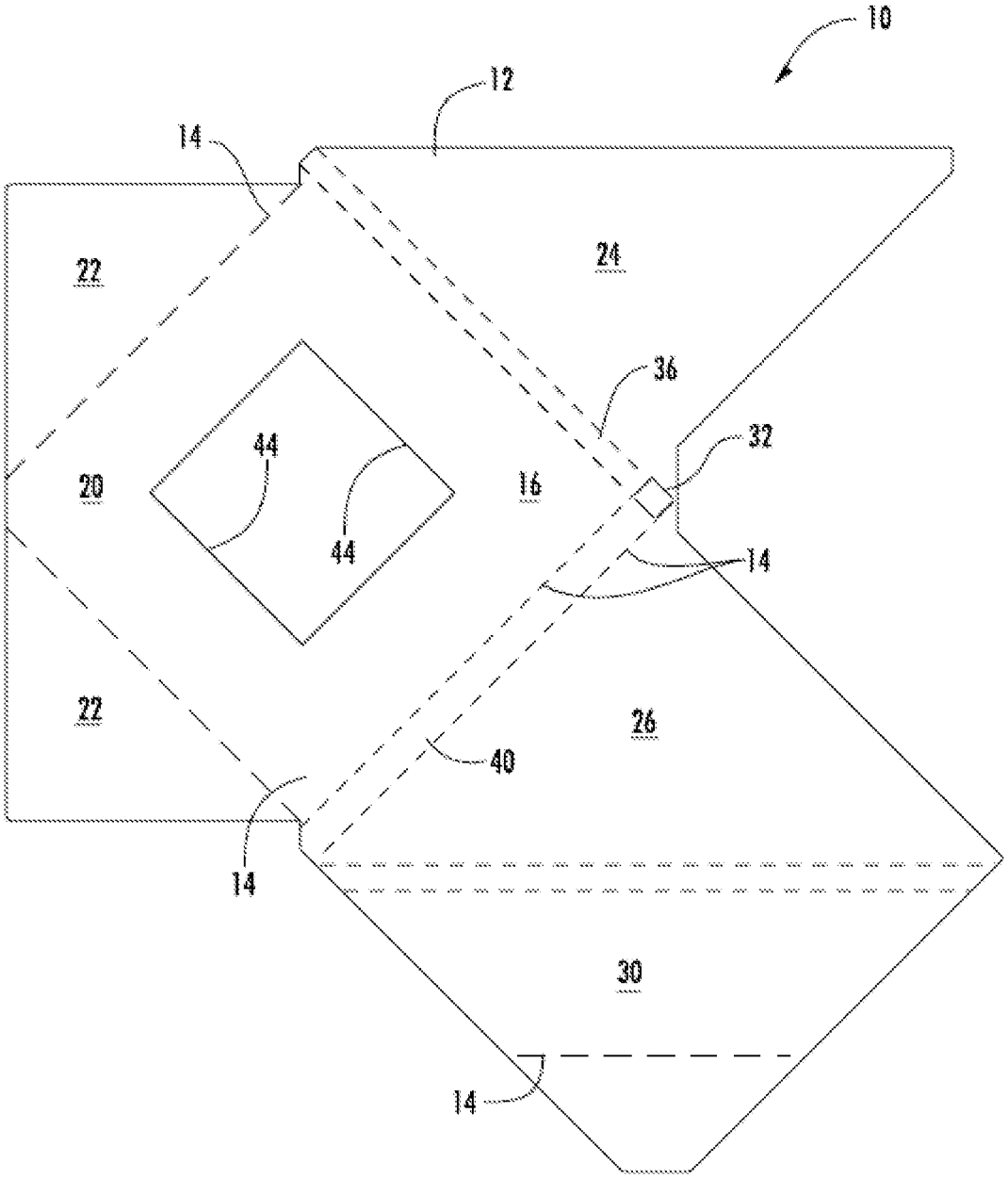
FIG. 1 is a plan view of a folding corner protector, according to an embodiment of the present invention, prior to folding.

Referring to FIG. 1, according to an embodiment of the present invention, a folding corner protector 10 begins as a single sheet 12 divided by a plurality of perforations 14, creases and/or other lines of weakness to facilitate subsequent folding. Advantageously, a plurality of corner protectors 10 can be cut from a single, large sheet of cardboard or other suitable material.

The sheet 12 includes an outer front wall section 16, inner front wall section 20, inner wall reinforcement sections 22, inner rear wall section 24, outer rear wall section 26 and retention flap 30. Advantageously, a gusset area 32 is retained in the sheet 12 at the meeting of the outer front wall, inner rear wall and outer rear wall sections 16, 24 and 26. Notches 44 are defined in connected sides of the outer wall front section 16 and inner front wall section 20. Directional terms such as "front," "rear" and "lower" are used herein for referential purposes and do not necessarily imply a required orientation of the folding corner protector 10 in use.

Figure 2:
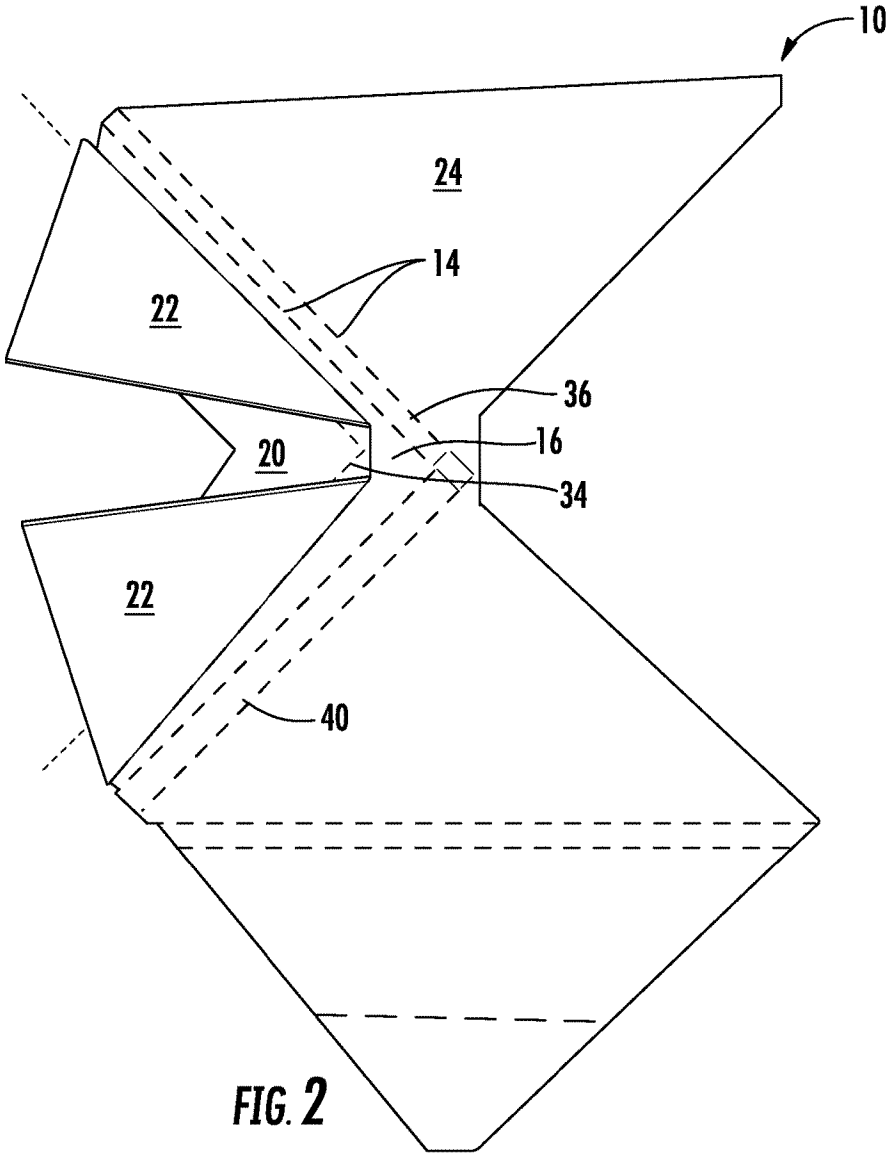
FIG. 2 is a perspective view of the folding corner protector of FIG. 1, in a first partially folded configuration.

Referring to FIG. 2, to begin folding the corner protector 10, the inner front wall section 20 is folded behind the outer front wall section 16 and the inner wall reinforcement sections 22 are folded behind the inner front wall section 20. It should be noted that a corner 34 to be protected (depicted in broken lines) is ultimately inserted between the inner front wall section 20 and the inner wall reinforcement sections 22. Thus, the protected corner 34 does not bear directly on outer edges 36, 40 of the corner protector 10.

Figure 3:
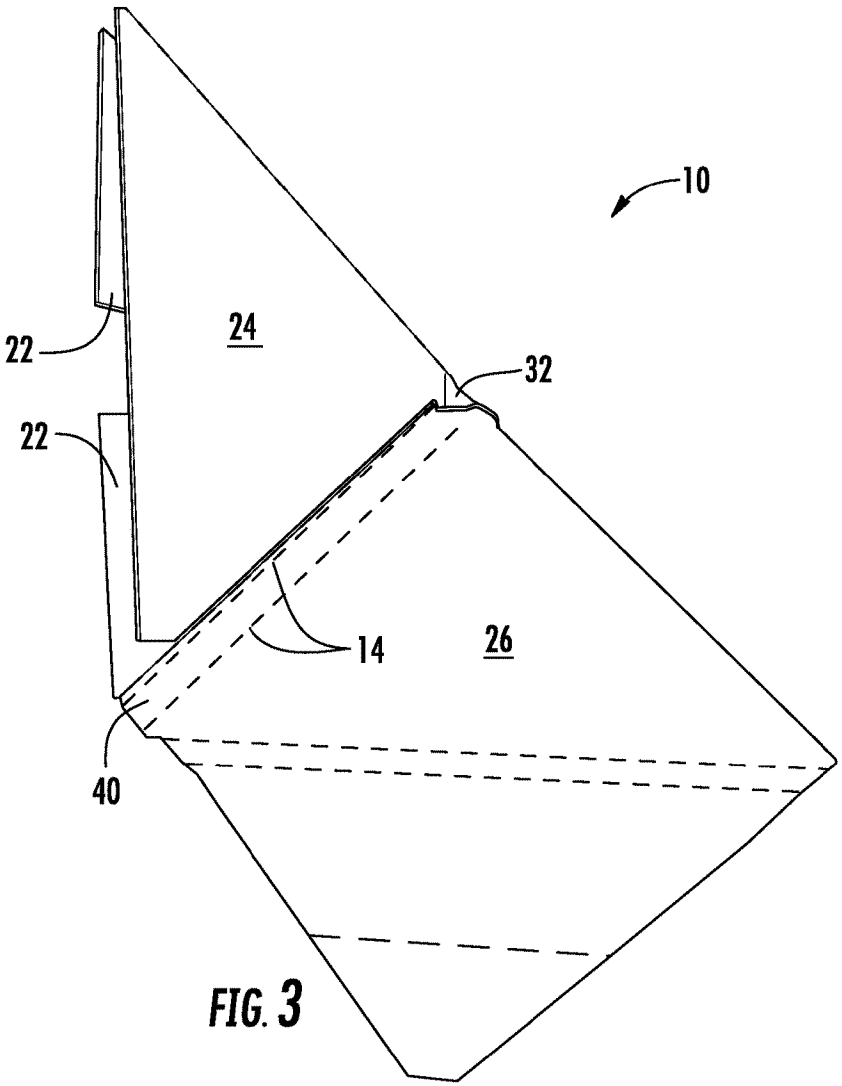
FIG. 3 is a perspective view of the folding corner protector of FIG. 1, in a second partially folded configuration.

Referring to FIG. 3, folding of the corner protector 10 continues by folding the inner rear wall section 24 over the inner wall reinforcement sections 22, the inner front wall section 20 and the outer front wall section 16. To facilitate this folding over the thickness of the already folded portions of the corner protector 10, the inner rear wall section 24 is separated from the outer front wall section 16 by parallel lines of weakness 14 (see FIG. 2) between which the outer edge 36 is formed. It will be appreciated that the gusset area 32 extends over the apex of the corner protector 10 between the edges 36, 40, providing additional protection.

Figure 4:
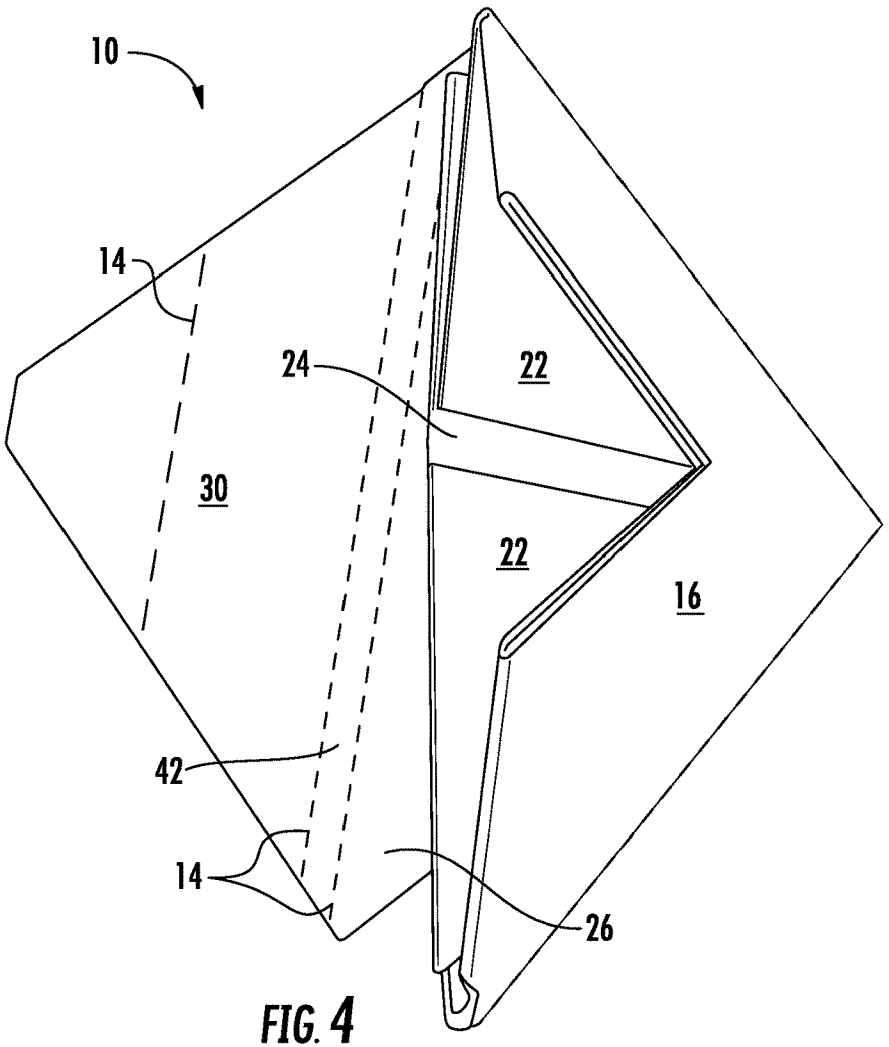
FIG. 4 is a perspective view of the folding corner protector of FIG. 1, in a third partially folded configuration.

Referring to FIG. 4, the outer rear wall section 26 is folded behind the inner rear wall section 24, inner wall reinforcement sections 22, inner front wall section 20 and outer front wall section 16. To accommodate the greater thickness of the already folded sections, parallel lines of weakness 14 (see FIG. 3) forming the edge 40 between the outer front wall section 16 and outer rear wall section 26 are spaced further apart than those forming the edge 36.

Figure 5:
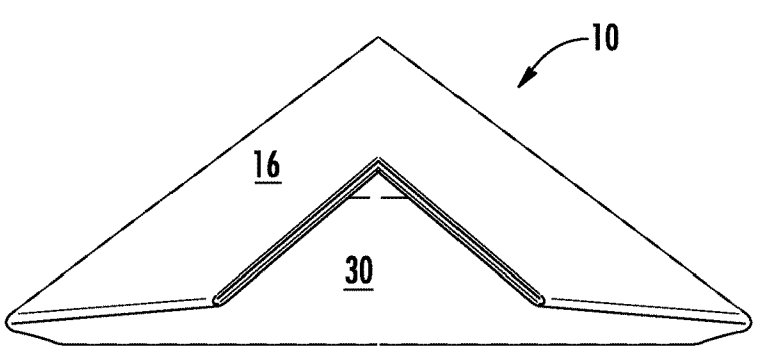
FIG. 5 is a perspective view of the folding corner protector of FIG. 1, fully folded.
Figure 6:
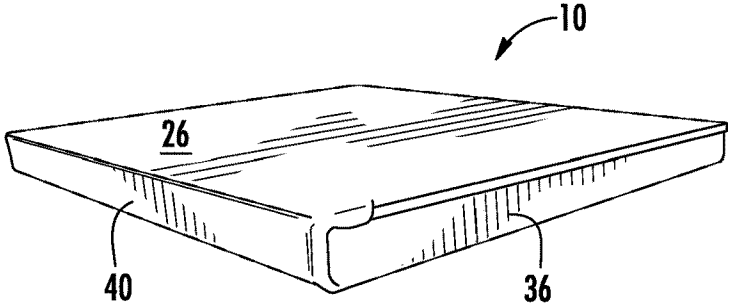
FIG. 6 is another perspective view of the folding corner protector of FIG. 1, fully folded.

Referring to FIGS. 5 and 6, folding of the corner protector 10 is finished by folding the retention flap 30 into the pocket formed by the other folded sections. Parallel lines of weakness 14 form a lower edge 42 between the retention flap 30 and the outer rear wall section 26 to facilitate this fold. An additional line of weakness 14 (see FIG. 4) can be formed across the retention flap 30 parallel to the edge 42 to facilitate insertion.

The folding corner protector depicted in FIGS. 1-6 is optimal for protecting a corner 34 traversing approximately a 90 degree angle. It will be appreciated that the configuration thus described can readily be modified to accommodate corners of other angles. For example, with reference to FIGS. 7-12, folding corner protector 10A is configured to better accommodate a corner 34A traversing approximately a 60 degree angle. Elements of the folding corner protector 10A are labeled to correspond to the elements of the folding corner protector 10, with like elements of the corner protector 10A sharing the same reference numeral followed by the letter "A." Folding the corner protector 10A proceeds exactly as described above in connection with the folding corner protector 10.

Figure 7:
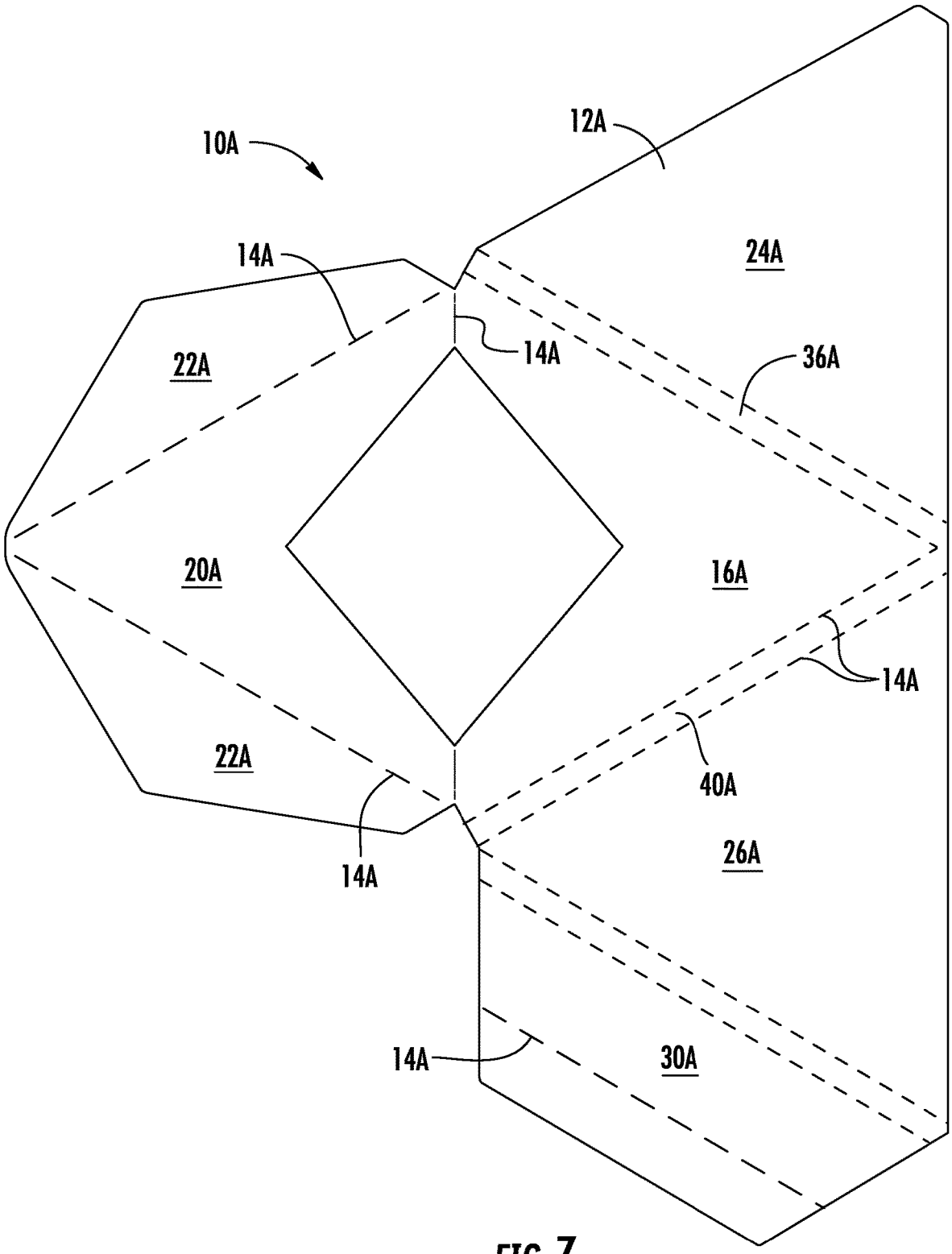
FIG. 7 is a plan view of a folding corner protector, according to another embodiment of the present invention, prior to folding.
Figure 9:
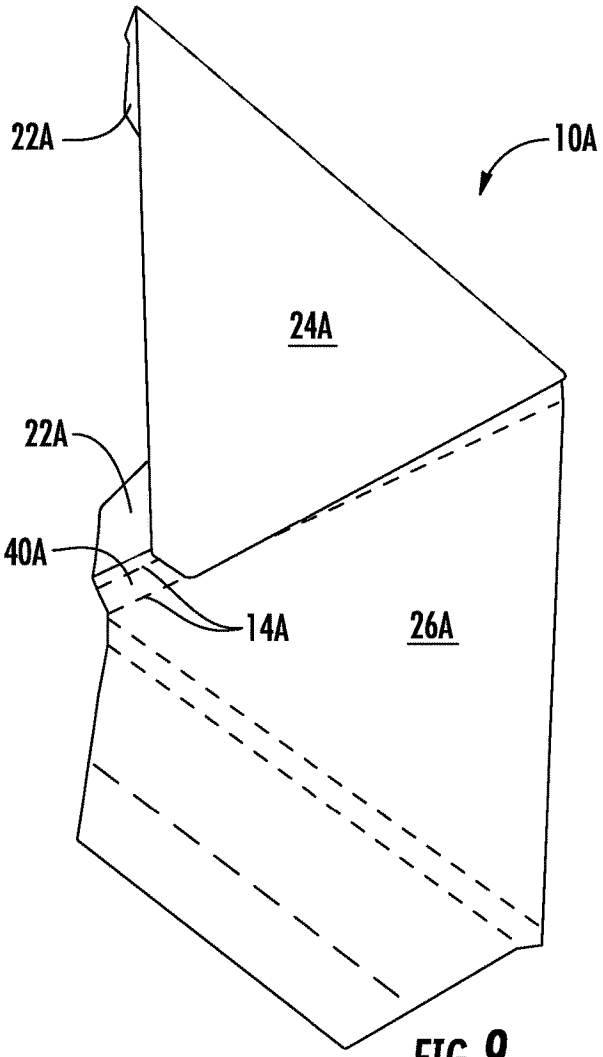
FIG. 9 is a perspective view of the folding corner protector of FIG. 7, in a second partially folded configuration.
Figure 8:
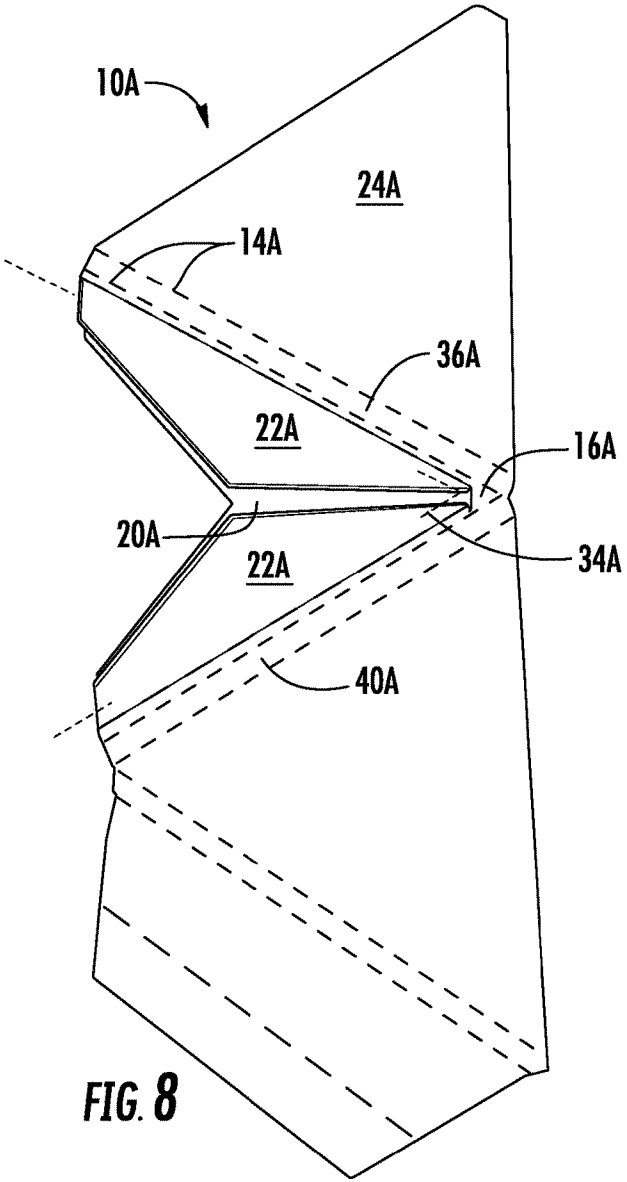
FIG. 8 is a perspective view of the folding corner protector of FIG. 7, in a first partially folded configuration.
Figure 11:
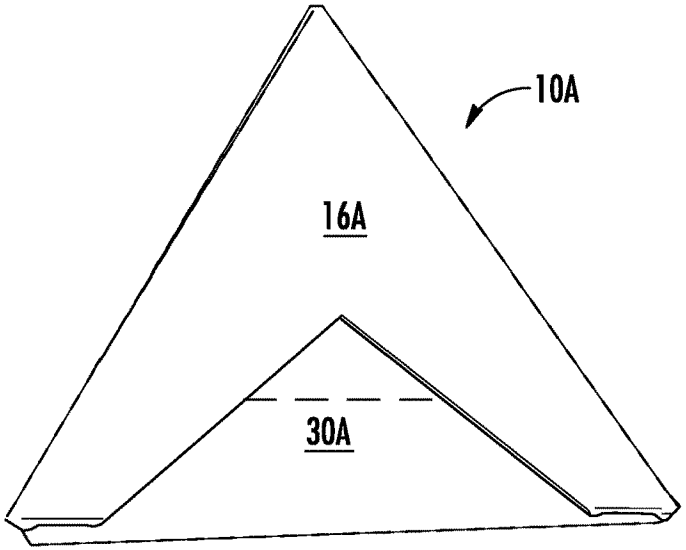
FIG. 11 is a perspective view of the folding corner protector of FIG. 7, fully folded.
Figure 12:
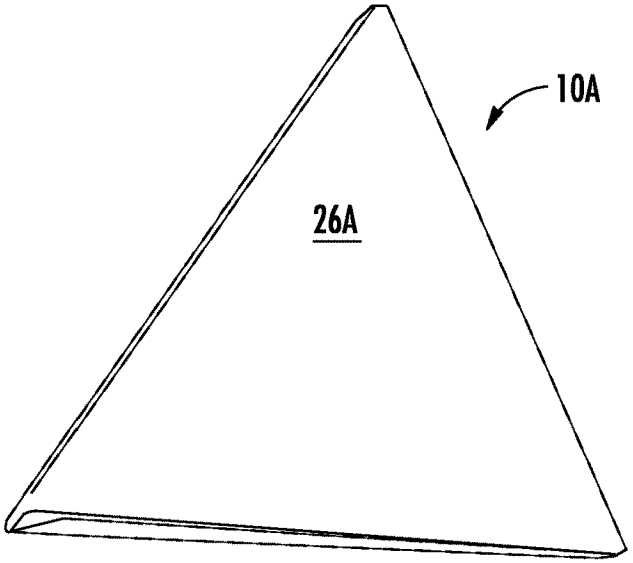
FIG. 12 is another perspective view of the folding corner protector of FIG. 1, fully folded.
Figure 10:
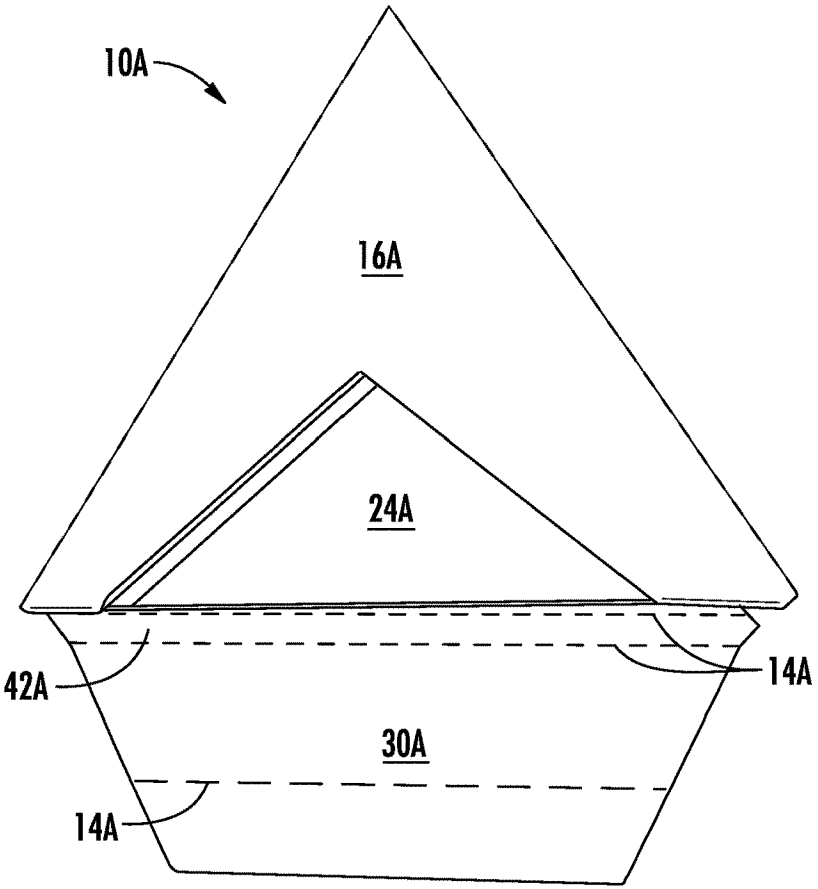
FIG. 10 is a perspective view of the folding corner protector of FIG. 7, in a third partially folded configuration.

Referring particularly to FIGS. 7 and 8, it will be noted that the folding corner protector 10A lacks the gusset area 32 of the corner protector 10. However, with the protected corner 34A seated inside the inner front wall section 20A and inner wall reinforcement sections 22A, the apex of the corner 34A is kept well clear of the corresponding apex of the corner protector 10.

It will be appreciated that folding corner protectors according to embodiments of the present invention offer a quick, easy and inexpensive means of preventing damage to (or by) corners during storage, handling or shipping of objects, and would be particularly advantageous protecting suitable corners of sheet metal components utilized in vehicle salvage operations.

In general, the foregoing embodiments are described for illustrative and exemplary purposes; the present invention is not necessarily limited thereto. Rather, those skilled in the art will appreciate that various modifications, as well as adaptations to particular circumstances, will fall within the scope of the invention as herein shown and described and of the claims appended hereto.

What is claimed is:

1. A corner protector comprising a single sheet of material folded along a plurality of lines of weakness to define:

a triangular outer front wall section having first, second and third outer front wall sides, an outer front wall notch being defined along the third outer front wall side;

a triangular inner front wall section having first, second and third inner front wall sides, an inner front wall notch being defined along the third inner front wall side, the third inner front wall side being connected to the third outer front wall side and the triangular inner front wall section being folded to lie adjacent to the triangular outer front wall section therealong;

first and second inner wall reinforcement sections being connected to the first and second inner front wall sides, respectively, and folded therealong to lie adjacent to the triangular inner front wall section such that the triangular inner front wall section lies between the triangular outer front wall section and the first and second inner wall reinforcement sections;

a triangular inner rear wall section connected to the first outer front wall side and folded therealong to lie adjacent to the first and second inner wall reinforcement sections such that the first and second inner wall reinforcement sections lie between the triangular inner front wall section and the triangular inner rear wall section;

a triangular outer rear wall section having first, second and third outer rear wall sides, the first outer rear wall side being connected to the second outer front wall side and folded therealong to lie adjacent to the triangular inner rear wall section such that the triangular inner rear wall section lies between the first and second inner wall reinforcement sections and the triangular outer rear wall section; and a retention flap connected to the third outer rear wall side and folded therealong to lie between the triangular inner front wall section and the triangular inner rear wall section.

* * * * *